United States Patent [19]

Reufer

[11] 4,073,421

[45] Feb. 14, 1978

[54] APPARATUS FOR PICKING UP RAPIDLY RUNNING FILAMENTS

[75] Inventor: Christian Reufer, Nottwil, Switzerland

[73] Assignee: Viscosuisse SA, Emmenbrucke, Switzerland

[21] Appl. No.: 564,235

[22] Filed: Apr. 2, 1975

[30] Foreign Application Priority Data

Apr. 22, 1974 Germany ..... 2419298

[51] Int. Cl.[2] ..... B65H 17/32

[52] U.S. Cl. ..... 226/97

[58] Field of Search ..... 226/91, 7, 97; 83/24, 83/98, 100

[56] References Cited

U.S. PATENT DOCUMENTS

| | | | |
|---|---|---|---|
| 2,661,588 | 12/1953 | Griset | 226/97 X |
| 3,423,000 | 1/1969 | Heinen | 226/97 |
| 3,452,626 | 7/1969 | Speakman | 83/98 |
| 3,452,910 | 7/1969 | Richter | 226/97 X |
| 3,570,339 | 3/1971 | Vandersip | 226/97 X |
| 3,718,270 | 2/1973 | Parmeggiani | 226/97 |
| 3,834,600 | 9/1974 | Benchemoul | 226/97 |

*Primary Examiner*—Richard A. Schacher

*Attorney, Agent, or Firm*—Seidel, Gonda & Goldhammer

[57] ABSTRACT

An improved method and apparatus are provided for picking up rapidly running filaments with an ejector type device which is operated by compressed air. According to the method, the filaments are caught and placed under the influence of the propulsion jets of the ejector no later than, and preferably before, the time when the filaments are cut. In one embodiment the apparatus for carrying out this method includes a lateral lead-in passage in the ejector for receiving filaments. The passage provides a path for the filaments, which path is inclined to the longitudinal axis of the ejector and extends from the inlet of the ejector, passes the exit openings of propulsion jets and leads laterally out from the propulsion tube of the ejector. In a second embodiment the ejector is provided with a lateral lead-in passage which is perpendicular to the longitudinal axis of the ejector. The passage provides a path for the filaments which by-passes the inlet to the ejector and extends past the exit openings of the propulsion jets. In this second embodiment, a second passage is also provided parallel to the longitudinal axis and perpendicular to the lead-in passage. This second passage provides a path for the filaments from the lead-in passage to the inlet of the ejector.

6 Claims, 8 Drawing Figures

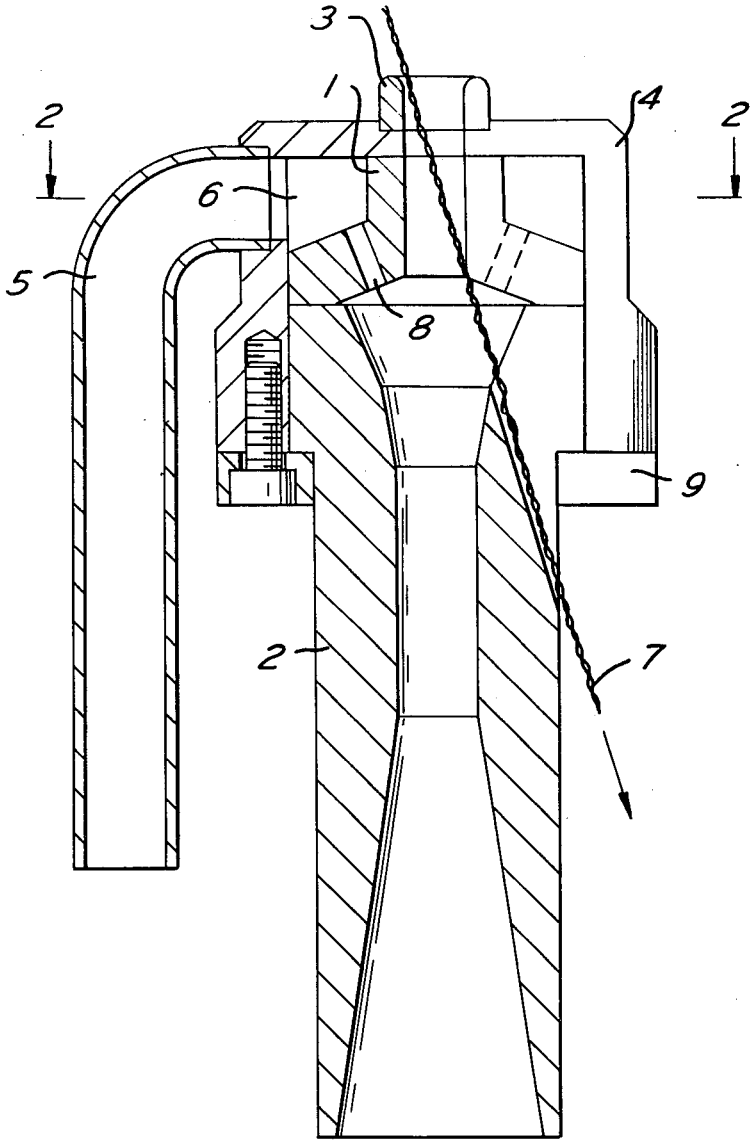
FIG. 1
FIG. 2
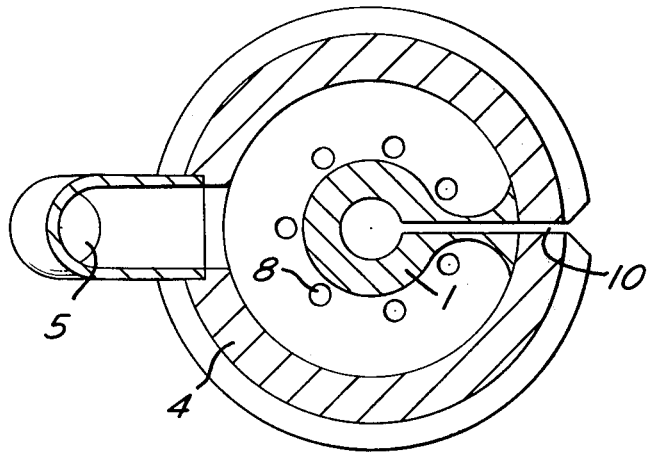

FIG. 6
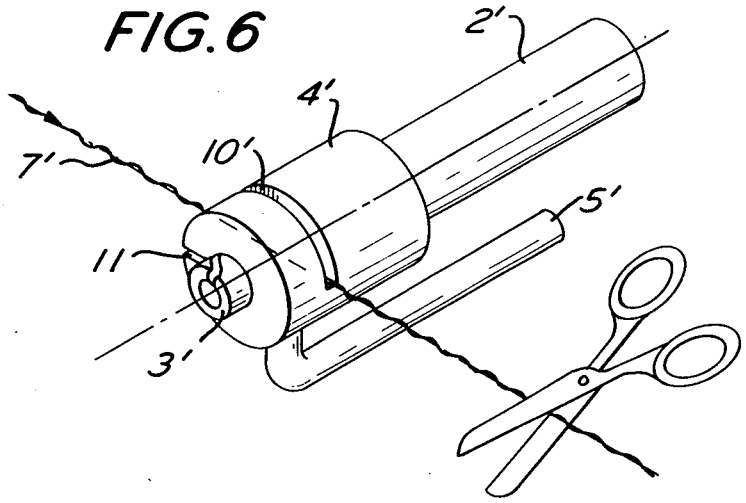
FIG. 7
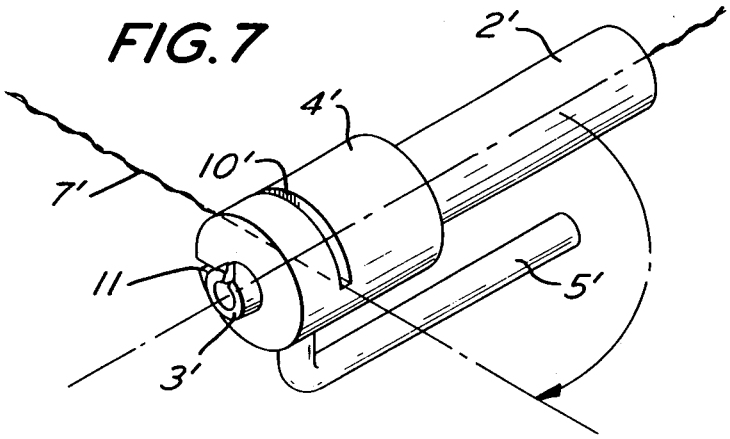
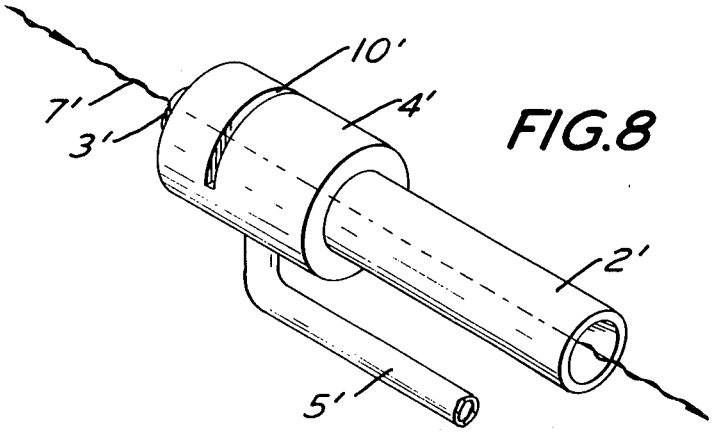
FIG. 8

APPARATUS FOR PICKING UP RAPIDLY RUNNING FILAMENTS

BACKGROUND OF THE INVENTION

The invention relates to a method for picking up rapidly moving filaments or threads. The invention is also directed to thread catching devices which are operated by compressed air. After being picked up by the thread catching devices, the filaments are cut and then carried through a propulsion nozzle to a catch site.

Thread catching devices of this type are especially useful where, for example, threads moving in manual operation from a spinning device to a winding bobbin must be picked up and temporarily carried to a catch site when the bobbin must be changed. During the bobbin exchange the thread runs to the catch site so that the spinning process need not be interrupted. Following bobbin exchange the moving threads are taken up by the new winding bobbin.

Known thread catching devices work according to the ejector principle, with compressed air escaping from one or several air nozzles, called propulsion nozzles or jets. The compressed air reaches a propulsion tube and induces a suction effect at the entry to the tube and a high air velocity inside the tube, which results in propelling the threads through the tube. The threads must be intercepted at the entry side in order to reach the propulsion tube where they are transported by the effect of the highest attainable thread tension, that is, by the highest possible propulsion force.

Both a high suction force and high propulsion force are required for the proper operation of such a thread catching device. However, practice has shown that these two forces cannot be brought to their maximum effect independently of each other. Thus, if an ejector nozzle is constructed for high suction, then its propulsion effect is low, and vice versa.

Thread catching devices with switchable nozzles are already known which can be set for high suction effect during filament pickup and thereafter for high propulsion effect. However, such devices have the drawback of carrying the thread in almost tensionless condition during the suction period, thereby creating a time lag before the nozzle can be switched to high propulsion. Leaving the threads almost tensionless creates a great danger of interruption of the thread feed between the thread supply and the thread catching device.

Another known method uses small projectiles for facilitating the smooth pickup of filaments by the thread catching device, but this method is cumbersome because of the necessity of disentanging the projectile from the filaments.

Further, a thread catching device is known which has a lead-in passage in front of the suction end of the main propulsion nozzle. The filaments or threads introduced into the lead-in passage are blown to the suction end of the main propulsion nozzle by means of a supplemental propulsion nozzle and a borehole running co-axially with the main propulsion nozzle. The supplemental propulsion nozzle necessarily makes the device more complicated. Besides, the air stream from the supplemental propulsion nozzle must again be accelerated by the main propulsion nozzle which prevents the attainment of the maximal achievable air velocity in the propulsion tube, and thereby prevents the highest possible thread tension. In addition, the threads enter the propulsion tube perpendicularly to its longidutinal axis and must consequently be re-directed by a right angle. This creates undesirable tension-reducing friction.

It is therefore the objective of the present invention to lead the threads to the thread catching device without auxiliary means and to pass them on immediately with maximal thread tension and velocity.

BRIEF SUMMARY OF THE INVENTION

The deficiencies of the prior art are solved or alleviated according to the method of the present invention wherein the filaments or threads are picked up by a thread catching device in a manner which places the filaments under the influence of the propulsion jet or jets no later than the moment at which they are cut.

Suction of the propulsion jets or nozzles plays no role in this method. That is, a very important feature of the invention is that the propulsion nozzles or jets can be adjusted for maximal propulsion effect. By obviating additionnal steps, the method of the present invention is also very economical in comparison with other known methods.

In one embodiment of the invention, the apparatus for carrying out the method includes an ejector provided with a lead-in passage for lateral pickup of threads in the direction of the longitudinal axis of the ejector. The lead-in passage is so constructed that the thread path runs at a slant or incline to the longitudinal axis through the inlet to the ejector, past the exit openings of the propulsion jets, and laterally out of the propulsion tube.

In another embodiment for carrying out the method, an ejector is provided with a lead-in passage extending perpencidularly to the longitudinal axis of the ejector for the lateral pickup of threads. The lead-in passage is so constructed that the thread path bypasses the inlet to the ejector and extends past the exit openings of the propulsion jets. In addition, a second passage parallel to the longitudinal axis and perpendicular to the lead-in passage provides a path for the filaments from the lead-in passage to the inlet of the ejector.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 1 is a longitudinal sectional view of a thread catching device according to one embodiment of the present invention.

FIG. 2 is a transverse sectional view of the thread catching device taken along line 2—2 of FIG. 1.

FIGS. 6, 7 and 8 are perspective views of the thread catching device shown in FIGS. 3, 4 and 5, illustrating the mode of operation of the device.

DETAILED DESCRIPTION OF THE PREFERRED EMBODIMENTS

Figure 3:
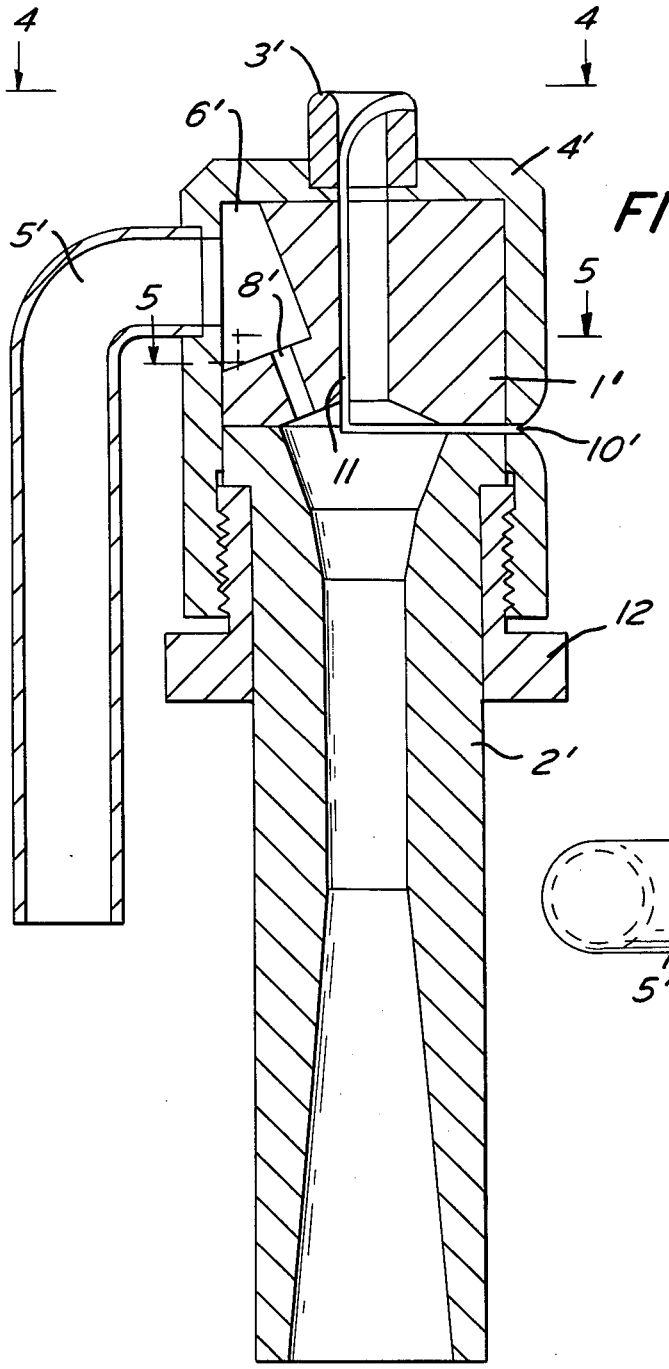
FIG. 3 is a longitudinal sectional view of a thread catching device according to another embodiment of the present invention.

The thread catching device shown in FIGS. 1 and 2 comprises an ejector having a propulsion tube 2 attached to a nozzle head 1. Placed above the nozzle head 1 is a cap 4 with an inlet lug 3. The cap 4 also encloses a portion of propulsion tube 2. Nozzle head 1, propulsion tube 2 and cap 4 are joined together by means of a flange 9 which rests against a recess in propulsion tube 2.

Propulsion jets or nozzles 8 are distributed around the circumference of nozzle head 1 (see FIG. 2). Pressurized air is supplied through tube 5 to the distribution chamber 6 where it reaches the inlets to the propulsion nozzles 8. A lead-in passage 10 in the form of a slot in the ejector runs through the inlet lug 3, the cap 4, the nozzle head 1, and the propulsion tube 2. The lead-in passage 10 picks up filaments or threads moving in the direction of the longitudinal axis of the ejector, with the thread path slanted or inclined to the longitudinal axis of the device and leading through the inlet lug 3 past the exit openings of the propulsion nozzles 8 and laterally out the propulsion tube 2, as shown by the plotted thread 7 in FIG. 1.

The thread catching device operates as follow. Assume that thread 7 is running from a supply source perpendicularly to a takeup spool. To illustrate the thread path, FIG. 1 must correspondingly be turned about 90 degrees counterclockwise. When the full takeup spool has to be replaced by an empty one, the thread catching device is brought to the thread so that the thread runs in the lead-in passage 10, as illustrated in FIG. 1. Then the thread is cut off a short distance beyond the thread catching device. As a result of the special guiding function of passage 10, the thread comes under the influence of the propulsion nozzles 8 closest to the thread (actually, as shown in FIG. 2, passage 10 and a thread in it run between two propulsion nozzles in front of their exit openings). As a result, the loose cut end of the thread or filament is immediately seized by the full force of propulsion nozzles 8 and is forced out through propulsion tube 2. The full length of the thread thus attains its maximal tension immediately upon severence.

A hose can be attached to propulsion tube 2 as a thread guide which will lead the thread to the pickup site.

Figure 4:
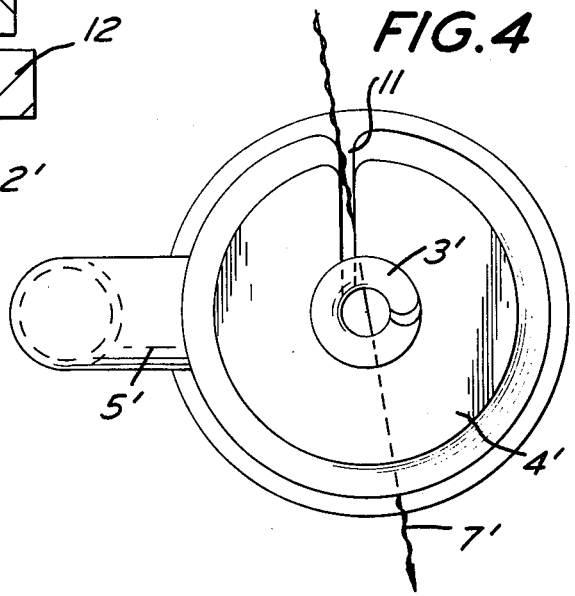
FIG. 4 is an end view of a thread catching device taken along line 4—4 of FIG. 3.
Figure 5:
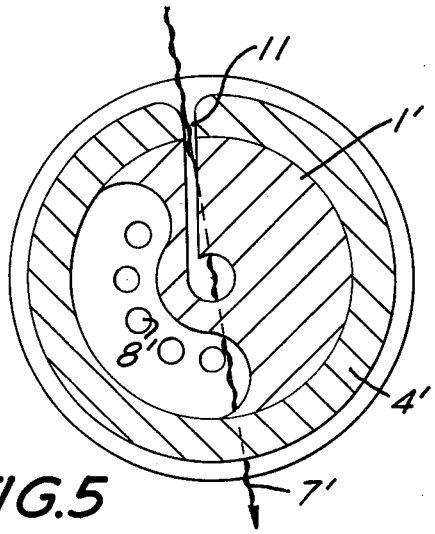
FIG. 5 is a transverse sectional view of a thread catching device taken along line 5—5 of FIG. 3.

The thread catching device shown in FIGS. 3, 4 and 5 comprises an ejector similar in construction to the above embodiment. The ejector comprises a nozzle head 1' with propulsion jets or nozzles 8', a propulsion tube 2', an inlet lug 3', a cap 4', a tube 5' for the supply of pressurized air, and a distribution chamber 6' for the pressurized air. A screw socket 12 provides the connection for nozzle head 1', propulsion tube 2' and cap 4'.

A lead-in passage 10' perpendicular to the longitudinal axis of the device is provided inside the cap 4'. Passage 10' is so constructed that the thread path bypasses the inlet lug 3' and runs past the exit openings of propulsion nozzles 8'. Lead-in passage 10' is then connected with inlet lug 3' by an elongated passage 11 which runs generally parallel to the longitudinal axis of the ejector and perpendicular to passage 10'. The termination of passage 11 in inlet lug 3' is advantageously formed in a helical shape so that passage 11 may pick up threads when the device is being moved in a circular path.

The thread catching device operates as follows. FIGS. 4 and 5 illustrate the path of the thread just following the engagement of the thread with the thread catching device. The thread path at this time is also illustrated in perspective in FIG. 6. Following severence, the thread is seized by the propelling force of the propulsion jets or nozzles 8' (compare FIGS. 3 and 5), and the cut end of the thread is again expelled through the propulsion tube 2'. Since the thread 7' is deflected at a right angle within the thread cathcing device, the device is then swung through an arc of 90°, as shown in FIG. 7, to the position indicated in FIG. 8. In the process, thread 7' enters elongated passage 11 and inlet lug 3' so that the thread 7' now passes without deflection in a straight line through the thread catching device.

Both types of thread catching device described above and illustrated in the drawings may be used for the change of bobbins, etc., either in manual or automatic equipment.

The present invention may be embodied in other specific forms without departing from the spirit or essential attributes thereof and, accordingly, reference should be made to the appended claims, rather than to the foregoing specification as indicating the scope of the invention.

I claim:

1. In an apparatus for picking up rapidly running filaments comprising an ejector operated by compressed air, said ejector having propulsion jets therein and a propulsion tube leading therefrom, said ejector having an inlet opening disposed above said propulsion jets and an outlet at the end of said propulsion tube, the improvement comprising a lateral lead-in passage formed in the body of said ejector for receiving filaments, said passage providing a path for filaments to be picked up, said path being inclined to the longitudinal axis of the ejector, and said path extending from said inlet opening of the ejector, passing the exit openings of the propulsion jets and leading laterally from said propulsion tube, said propulsion jets being disposed in a generally circular pattern around the interior of said propulsion tube and adjacent said inlet, the exit openings of said propulsion jets being disposed generally about a single plane passing transversely of the longitudinal axis of said ejector.

2. An ejector in accordance with claim 1 wherein each propulsion jet is disposed toward the central axis of said propulsion tube.

3. An ejector in accordance with claim 2 wherein said passage includes a laterally extending slot in the wall of said propulsion tube, said slot being disposed below the elevation of said propulsion jets and the base of said slot within the propulsion tube being at an acute angle relative to the longitudinal axis of said propulsion tube.

4. In an apparatus for picking up rapidly running filaments comprising an ejector operated by compressed air, said ejector having propulsion jets therein and a propulsion tube leading therefrom, said ejector having an inlet opening disposed above said propulsion jets and an outlet at the end of said propulsion tube, the improvement comprising a lateral passage formed in the body of said ejector for receiving filaments, said passage being perpendicular to the longitudinal axis of said ejector and providing a path for filaments to be picked up, said path being disposed below and bypassing said inlet opening to said ejector and extending past and adjacent to the exit openings of said propulsion jets, and a second passage formed in the body of said ejector generally parallel to the longitudinal axis of the ejector and perpendicular to said lead-in passage, said second passage connecting with said lead-in passage and providing a path for the filaments from the lead-in passage to the inlet of the ejector.

5. An ejector in accordance with claim 4 wherein said propulsion jets are disposed in a partial arcuate pattern around the interior of said propulsion tube and adjacent said inlet opening.

6. An ejector in accordance with claim 4 wherein said exit openings of said propulsion jets are disposed generally about a single plane passing transversely of the longitudinal axis of said ejector.

* * * * *